US008864537B1

(12) United States Patent
Wiatrowski

(10) Patent No.: US 8,864,537 B1
(45) Date of Patent: Oct. 21, 2014

(54) MARINE PROPULSION SYSTEM GEAR CASE ASSEMBLY

(71) Applicant: BRP US Inc., Sturtevant, IL (US)

(72) Inventor: Darrell Wiatrowski, Libertyville, IL (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 14/026,016

(22) Filed: Sep. 13, 2013

Related U.S. Application Data

(63) Continuation-in-part of application No. 13/715,211, filed on Dec. 14, 2012, now abandoned.

(51) Int. Cl.
*B63H 20/14* (2006.01)
*B63H 21/38* (2006.01)

(52) U.S. Cl.
CPC ..... *B63H 21/386* (2013.01)
USPC ..... 440/75

(58) Field of Classification Search
USPC ..... 440/75, 78, 83
IPC ..... B63H 23/02,23/04, 23/321; F02B 61/045
See application file for complete search history.

(56) References Cited

U.S. PATENT DOCUMENTS 2,549,477 A 4/1951 Kiekhaefer
5,643,025 A 7/1997 Suzuki
5,931,711 A 8/1999 Nakamura
6,176,750 B1 1/2001 Alexander et al.
6,217,400 B1 4/2001 Natsume
7,530,869 B2 5/2009 Ide et al.
8,105,122 B2 1/2012 Inaba
8,303,359 B2 11/2012 Matsuda et al.

FOREIGN PATENT DOCUMENTS

JP 2005132150 A1 5/2005

OTHER PUBLICATIONS

English Abstract of JP2005132150, Published May 26, 2005, Retrieved from the internet: http://worldwide.espacenet.com on Oct. 9, 2013.

*Primary Examiner* — Stephen Avila
(74) *Attorney, Agent, or Firm* — BCF LLP

(57) ABSTRACT

A gear case assembly for a marine propulsion system has a gear case, a driveshaft, a propeller shaft, and a transmission chamber. A driveshaft passage fluidly connects to the transmission chamber. A lubricant return passage fluidly connects to the transmission chamber and the driveshaft passage. A pump is driven by the driveshaft. A first lubricant filling port fluidly communicates one of the lubricant return passage and the driveshaft passage with an exterior of the gear case. A second lubricant filling port fluidly communicates one of the lubricant return passage and the transmission chamber with the exterior of the gear case. First and second plugs are selectively disposed in the first and second lubricant filling ports respectively. A check valve is disposed in the lubricant return passage between the first and second lubricant filling ports. The check valve prevents lubricant to flow through the check valve away from the transmission chamber.

22 Claims, 9 Drawing Sheets

MARINE PROPULSION SYSTEM GEAR CASE ASSEMBLY

CROSS-REFERENCE

The present application in a continuation-in-part of U.S. patent application Ser. No. 13/715,211, filed Dec. 14, 2012, now abandoned, the entirety of which is incorporated herein by reference.

FIELD OF THE INVENTION

The present invention relates to a marine propulsion system gear case assembly.

BACKGROUND

Many marine propulsion systems, such as marine outboard engines, have a gear cases assembly. One of the functions of the gear case assembly is to transmit torque from the engine to the propeller or impeller of the propulsion system. The gear case assembly includes a gear case that houses various shafts and gears used to achieve this torque transmission.

The components housed in the gear case used for the torque transmission are typically bathed in lubricant. During operation of the propulsion system, a pump circulates the lubricant through various chambers and passages formed by the gear case and housing the various components.

In order to initially fill these chambers and passages and later replace the lubricant in these chambers and passages, some gear case assemblies are provided with one upper and one lower lubricant filling port. Each port fluidly communicates a corresponding one of the chambers or passages with the exterior of the gear case and is closed by a plug. To fill the chambers and passages with lubricant, the plugs are removed from the filling ports and lubricant is pumped through the lower lubricant filling port. When lubricant begins to come out of the upper lubricant filling port, the chambers are considered to be filled with lubricant and the plugs are placed in the lubricant filling ports. However, as will be explained below, the chambers are not actually full of lubricant. To remove the lubricant from the chambers and passages, the both plugs are removed and lubricant is drained out.

When filling the chambers and passages with lubricant, the flow of lubricant in one or more of the chambers can be obstructed by various constraints. This is the case for example for the driveshaft passage that houses a portion of the driveshaft. Flow of lubricant through the driveshaft passage may be partially obstructed by the various bearings positioned between the driveshaft and the wall of the driveshaft passage. When filling the chambers and passages with lubricant as described above, the lubricant flows more quickly up unobstructed or less obstructed chambers and passages than passages that have obstructions such as the driveshaft passage. As a result, the pumped lubricant may reach the upper lubricant filling port even though the driveshaft passage is only partially filled with lubricant. This means that when the plugs are replaced in the lubricant filling ports, a volume of air is still present in the driveshaft passage.

Over time, the lubricant levels off in the gear case and some air remains present above the lubricant. The final level of lubricant depends on the overall volume of the chambers and passages. In gear case assemblies where this volume is relatively large, the final level of lubricant is typically high enough to bathe in lubricant all of the components that need to be lubricated. However, in gear case assemblies where the overall volume of the chambers and passages is relatively small, the final level of lubricant can be too low to bathe all of these components in lubricant. One example of a gear case assembly where the overall volume of the chambers and passages is relatively small is a gear case assembly in which the transmission actuator includes an electric motor disposed in the gear case. The electric motor has to be isolated from the chambers and passages in which lubricant is present, thus reducing the volume that could otherwise be available for lubricant.

One solution consists in filling the chambers and passages in multiple steps. In this solution, the chambers and passages are filled as described above, except that the plugs are not placed in the oil filling ports right away, and some time is then allowed to lapse to give time to the lubricant to level off. More lubricant is then pumped in the chambers and passages until it starts coming out of the upper lubricant filling port again, and more time is then allowed to lapse to give time to the lubricant to level off. This step is repeated until it is determined that all of the chambers and passages are actually full of lubricant at which point the plugs placed in the oil filling ports. As would be appreciated, this method is very time consuming.

There is therefore a need for a gear case assembly that permits the filling of the lubricant chambers and passages in the gear case while limiting the amount of air remaining in the lubricant chambers and passages at the end of the filling operation.

SUMMARY

It is an object of the present invention to ameliorate at least some of the inconveniences present in the prior art.

In one aspect, a gear case assembly for a marine propulsion system has a gear case having a first end and a second end. The first end is adapted to connect the gear case to a remainder of the marine propulsion system. The second end is disposed opposite the first end. A driveshaft is disposed at least in part in the gear case. The driveshaft has a driveshaft axis. A propeller shaft is operatively connected to an end of the driveshaft. The propeller shaft is disposed at an angle to the driveshaft. A transmission chamber is defined in the gear case. The end of the driveshaft and at least a portion of the propeller shaft are disposed in the transmission chamber. A driveshaft passage is fluidly connected to the transmission chamber. The driveshaft passage houses at least a portion of the driveshaft. The driveshaft passage is disposed between the first end of the gear case and the transmission chamber in a direction parallel to the driveshaft axis. A lubricant return passage is fluidly connected to the transmission chamber and the driveshaft passage. The lubricant return passage is disposed between the first end of the gear case and the transmission chamber in a direction parallel to the driveshaft axis. A pump is driven by the driveshaft. During operation of the driveshaft: the pump pumps lubricant from the transmission chamber to the driveshaft passage, and from the driveshaft passage, the lubricant flows through the lubricant return passage and back to the transmission chamber. A first lubricant filling port for fluidly communicating one of the lubricant return passage and the driveshaft passage with an exterior of the gear case defines an aperture in the one of the lubricant return passage and the driveshaft passage. A first plug is selectively disposed in the first lubricant filling port. A second lubricant filling port for fluidly communicating one of the lubricant return passage and the transmission chamber with the exterior of the gear case defines an aperture in the one of the lubricant return passage and the transmission chamber. The second lubricant filling port is closer to the second end of the gear case than the first lubricant filling port in the direction parallel to the driveshaft. A second plug is selectively disposed in the second lubricant filling port. A check valve is disposed in the lubricant return passage between the first and second lubricant filling ports in the direction parallel to the driveshaft axis. The check valve permits lubricant to flow through the check valve toward the transmission chamber. The check valve prevents lubricant to flow through the check valve away from the transmission chamber.

In a further aspect, the first lubricant filling port fluidly communicates the lubricant return passage with the exterior of the gear case and the aperture defined by the first lubricant filling port is defined in the lubricant return passage.

In an additional aspect, the second lubricant filling port fluidly communicates the transmission chamber with the exterior of the gear case and the aperture defined by the second lubricant filling port is defined in the transmission chamber.

In a further aspect, the propeller shaft is perpendicular to the driveshaft.

In an additional aspect, a first bevel gear is disposed on the end of the driveshaft. A second bevel gear is operatively connected to the propeller shaft. The second bevel gear meshes with the first bevel gear. The first and second bevel gears are disposed in the transmission chamber.

In a further aspect, the second bevel gear is selectively connected to the propeller shaft. A third bevel gear is selectively connected to the propeller shaft. The third bevel gear meshes with the first bevel gear. The third bevel gear is disposed in the transmission chamber. The second and third bevel gears are disposed on opposite sides of the driveshaft axis. A transmission actuator assembly is provided for selectively operatively connecting one of the second and third bevel gears with the propeller shaft, with the one of the second and third bevel gears driving the propeller shaft.

In an additional aspect, a sleeve is disposed on the propeller shaft. The sleeve is slidable along the propeller shaft. The sleeve is rotationally fixed relative to the propeller shaft. A rocker is connected to the sleeve. A shift rod is connected to the rocker and the transmission actuator assembly. The transmission actuator assembly causes translation of the shift rod, which in turn causes the rocker to move the sleeve to one of: a first position where the sleeve engages the second bevel gear; a second position where the sleeve engages the third bevel gear; and a neutral position where the sleeve is disengaged from both the second and third bevel gears.

In a further aspect, the transmission actuator assembly includes an electric motor.

In an additional aspect, the transmission actuator assembly is disposed at least in part in an actuator chamber formed by the gear case.

In a further aspect, the actuator chamber is disposed forward of the lubricant return passage and the driveshaft passage. The actuator chamber is disposed between the transmission chamber and the first end of the gear case in the direction parallel to the driveshaft axis. The lubricant return passage is disposed between the actuator chamber and the driveshaft passage.

In an additional aspect, the pump is an Archimedes screw.

In a further aspect, the Archimedes screw includes a pump housing disposed in the driveshaft passage around the driveshaft. The pump housing defines an internal thread.

In an additional aspect, the first lubricant filling port is disposed between the Archimedes screw and the first end of the gear case in the direction parallel to the driveshaft.

In a further aspect, a connection passage fluidly communicates the driveshaft passage with the lubricant return passage.

In an additional aspect, the connection passage is disposed between the first lubricant filling port and the first end of the gear case in the direction parallel to the driveshaft.

In a further aspect, a bearing is disposed between the driveshaft and a wall of the driveshaft passage. An inlet of the connection passage is disposed closer to the first end of the gear case than the bearing in the direction parallel to the driveshaft.

In an additional aspect, the bearing is disposed between the first lubricant filling port and the second end of the gear case in the direction parallel to the driveshaft.

In a further aspect, the check valve is a ball valve.

In an additional aspect, the first lubricant filling port fluidly communicates the one of the lubricant return passage and the driveshaft passage with a first side of the exterior of the gear case. The second lubricant filling port fluidly communicates the one of the lubricant return passage and the transmission chamber with the first side of the exterior of the gear case.

In a further aspect, a diameter of the driveshaft passage is larger than a diameter of the lubricant return passage.

In an additional aspect, a diameter of the lubricant return passage is larger than a diameter of the connection passage.

In another aspect, a marine outboard engine has an engine, a cowling housing at least in part the engine, a midsection connected to the engine, and a gear case having a first end and a second end. The first end is connected to the midsection. The second end is disposed opposite the first end. A driveshaft is disposed at least in part in the gear case and is operatively connected to the engine. The driveshaft has a driveshaft axis. A propeller shaft is operatively connected to an end of the driveshaft. The propeller shaft is disposed at an angle to the driveshaft. A propeller is mounted on the propeller shaft. A transmission chamber is defined in the gear case. The end of the driveshaft and at least a portion of the propeller shaft are disposed in the transmission chamber. A driveshaft passage is fluidly connected to the transmission chamber. The driveshaft passage houses at least a portion of the driveshaft. The driveshaft passage is disposed between the first end of the gear case and the transmission chamber in a direction parallel to the driveshaft axis. A lubricant return passage is fluidly connected to the transmission chamber and the driveshaft passage. The lubricant return passage is disposed between the first end of the gear case and the transmission chamber in a direction parallel to the driveshaft axis. A pump is driven by the driveshaft. During operation of the driveshaft: the pump pumps lubricant from the transmission chamber to the driveshaft passage, and from the driveshaft passage, the lubricant flows through the connection passage into the lubricant return passage and back to the transmission chamber. A first lubricant filling port for fluidly communicating one of the lubricant return passage and the driveshaft passage with an exterior of the gear case defines an aperture in the one of the lubricant return passage and the driveshaft passage. A first plug is selectively disposed in the first lubricant filling port. A second lubricant filling port for fluidly communicating one of the lubricant return passage and the transmission chamber with the exterior of the gear case defines an aperture in the one of the lubricant return passage and the transmission chamber. The second lubricant filling port is closer to the second end of the gear case than the first lubricant filling port in the direction parallel to the driveshaft. A second plug is selectively disposed in the second lubricant filling port. A check valve is disposed in the lubricant return passage between the first and second lubricant filling ports in the direction parallel to the driveshaft axis. The check valve permits lubricant to flow through the check valve toward the transmission chamber. The check valve prevents lubricant to flow through the check valve away from the transmission chamber.

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects and advantages of embodiments of the present invention will become apparent from the following description, the accompanying drawings and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

The present invention will be described with respect to a gear case assembly for a marine outboard engine. However, it is contemplated that the present invention could be used in gear case assemblies for other types on marine propulsion systems, such as, for example, a stern drive.

Figure 1:
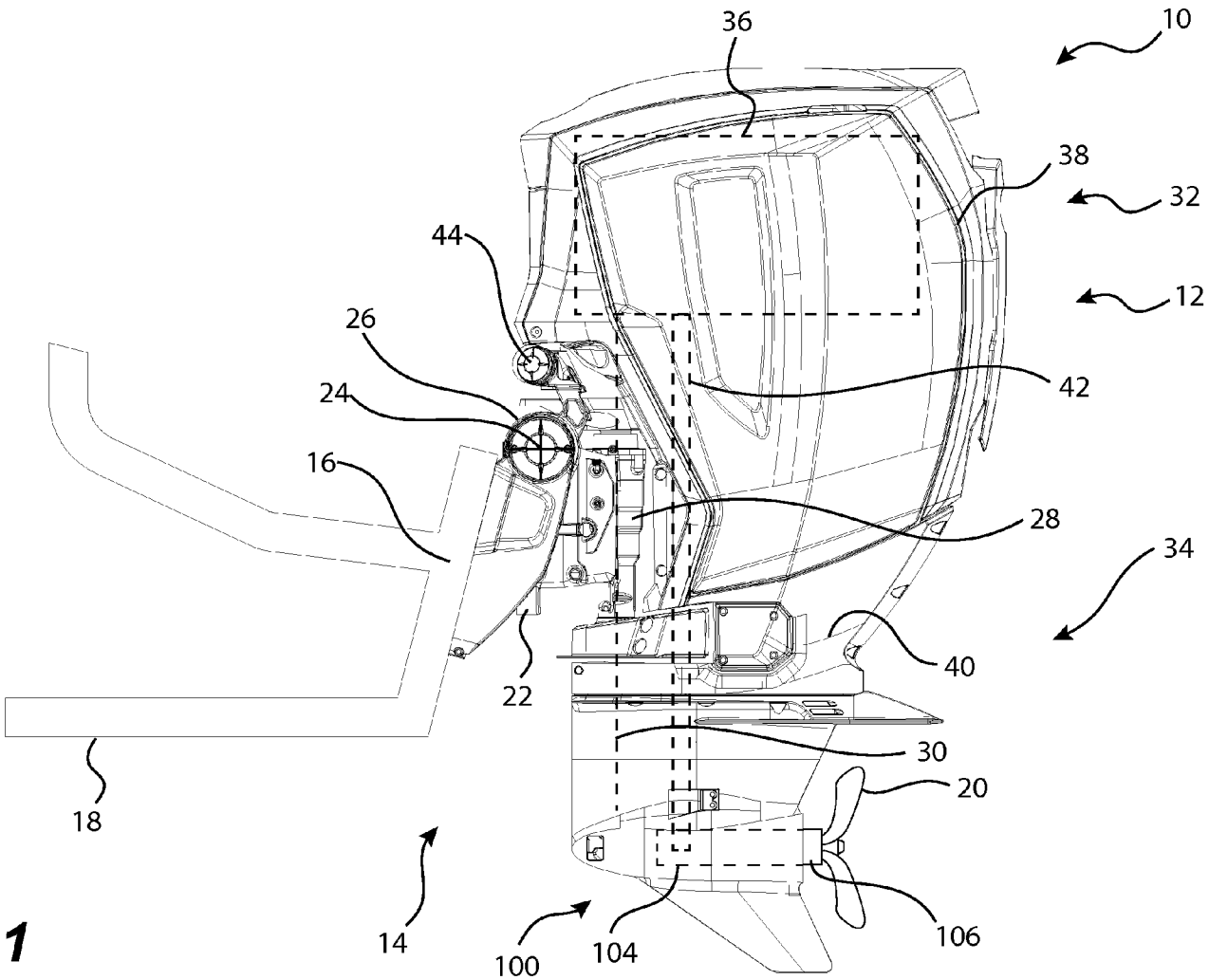
FIG. 1 is a left side elevation view of a marine outboard engine mounted to a stern of a boat.

With reference to FIG. 1, a marine outboard engine 10, shown in the upright position, includes a drive unit 12 and a bracket assembly 14. The bracket assembly 14 supports the drive unit 12 on a transom 16 of a hull 18 of an associated watercraft such that a propeller 20 is in a submerged position with the watercraft resting relative to a surface of a body of water. The drive unit 12 can be trimmed up or down relative to the hull 18 by linear actuators 22 of the bracket assembly 14 about a tilt/trim axis 24 extending generally horizontally. The drive unit 12 can also be tilted up or down relative to the hull 18 by a rotary actuator 26 of the bracket assembly 14 about the tilt/trim axis 24. The drive unit 12 can also be steered left or right relative to the hull 18 by another rotary actuator 28 of the bracket assembly 14 about a steering axis 30. The steering axis 30 extends generally perpendicularly to the tilt/trim axis 24. When the drive unit 12 is in the upright position as shown in FIG. 1, the steering axis 30 extends generally vertically.

The drive unit 12 includes an upper portion 32 and a lower portion 34. The upper portion 32 includes an engine 36 (schematically shown in dotted lines) surrounded and protected by a cowling 38. The engine 36 housed within the cowling 38 is an internal combustion engine, such as a two-stroke or four-stroke engine, having cylinders extending generally horizontally when the drive unit 12 is in an upright position as shown. It is contemplated that other types of engines could be used and that the cylinders could be oriented differently. The lower portion 34 includes the gear case assembly 100, which includes a gear case 102, the propeller 20, and components located inside the gear case 102 described in detail below. A midsection 40 is connected between the engine 36 and the gear case 102. It is contemplated that the midsection 40 could house a portion of an exhaust system of the outboard engine 10.

The engine 36 is coupled to a driveshaft 42 (schematically shown in dotted lines). When the drive unit 12 is in the upright position, the driveshaft 42 is oriented vertically. It is contemplated that the driveshaft 42 could be oriented differently relative to the engine 36. The driveshaft 42 is disposed in the cowling 38, passes through the midsection 40 and is coupled to a drive mechanism, which includes a transmission 104 and the propeller 20 mounted on a propeller shaft 106 as will be discussed in greater detail below. In FIG. 1, the propeller shaft 106 is perpendicular to the driveshaft 42, however it is contemplated that it could be at other angles. The driveshaft 42 and the transmission 104 transfer the power of the engine 36 to the propeller 20 mounted on the rear side of the gear case 102 of the drive unit 12. It is contemplated that the propulsion system of the outboard engine 10 could alternatively include a jet propulsion device, turbine or other known propelling device. It is further contemplated that the bladed rotor 20 could alternatively be an impeller.

To facilitate the installation of the outboard engine 10 on the watercraft, the outboard engine 10 is provided with a connection box 44. The connection box 44 is connected on top of the rotary actuator 26. As a result, the connection box 44 pivots about the tilt/trim axis 24 when the drive unit 12 is tilted, but does not pivot about the steering axis 30 when the drive unit 12 is steered. It is contemplated that the connection box 48 could be mounted elsewhere on the bracket assembly 14 or on the drive unit 12. Devices located inside the cowling 38 which need to be connected to other devices disposed externally of the outboard engine 10, such as on the deck or hull 18 of the watercraft, are provided with lines which extend inside the connection box 44. Similarly, the corresponding devices disposed externally of the outboard engine 10 are also provided with lines that extend inside the connection box 44 where they are connected with their corresponding lines from the outboard engine 10. It is contemplated that one or more lines could be connected between one or more devices located inside the cowling 38 to one or more devices located externally of the outboard engine 10 and simply pass through the connection box 44. It is contemplated that the connection box 44 could be omitted.

Other known components of an engine assembly are included within the cowling 38, such as a starter motor, an alternator and the exhaust system. As it is believed that these components would be readily recognized by one of ordinary skill in the art, further explanation and description of these components will not be provided herein.

The gear case assembly 100 will now be described in more detail with reference to FIGS. 2 to 6. The gear case assembly 100 is shown in the figures in its upright position (i.e. as shown in FIG. 1). The gear case assembly 100 includes the gear case 102 housing portions of the driveshaft 42, the propeller shaft 106, the transmission 104 and an electric transmission actuator assembly 108.

Figure 2:
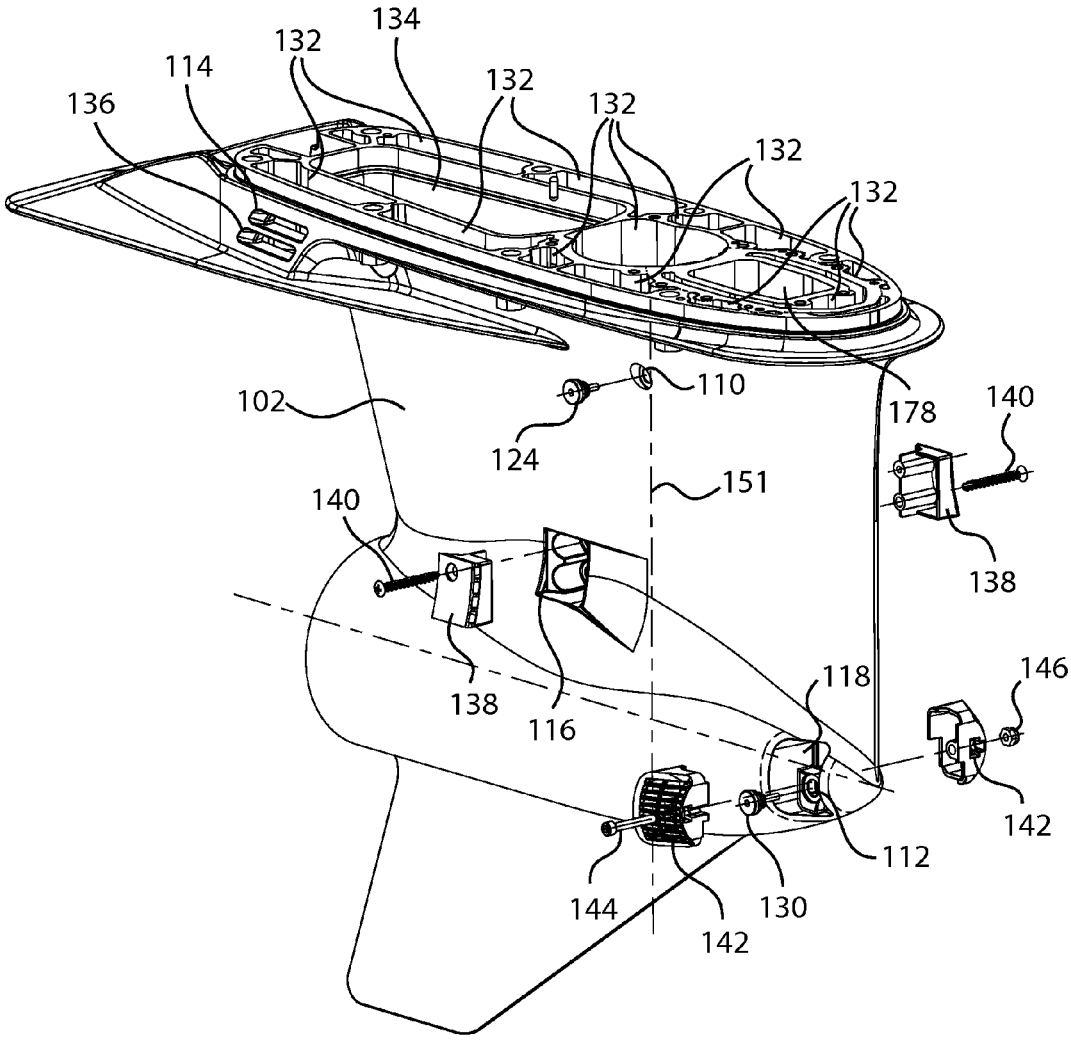
FIG. 2 is an exploded perspective view taken from a front, right side of a gear case and associated components of the outboard engine of FIG. 1.
Figure 4:
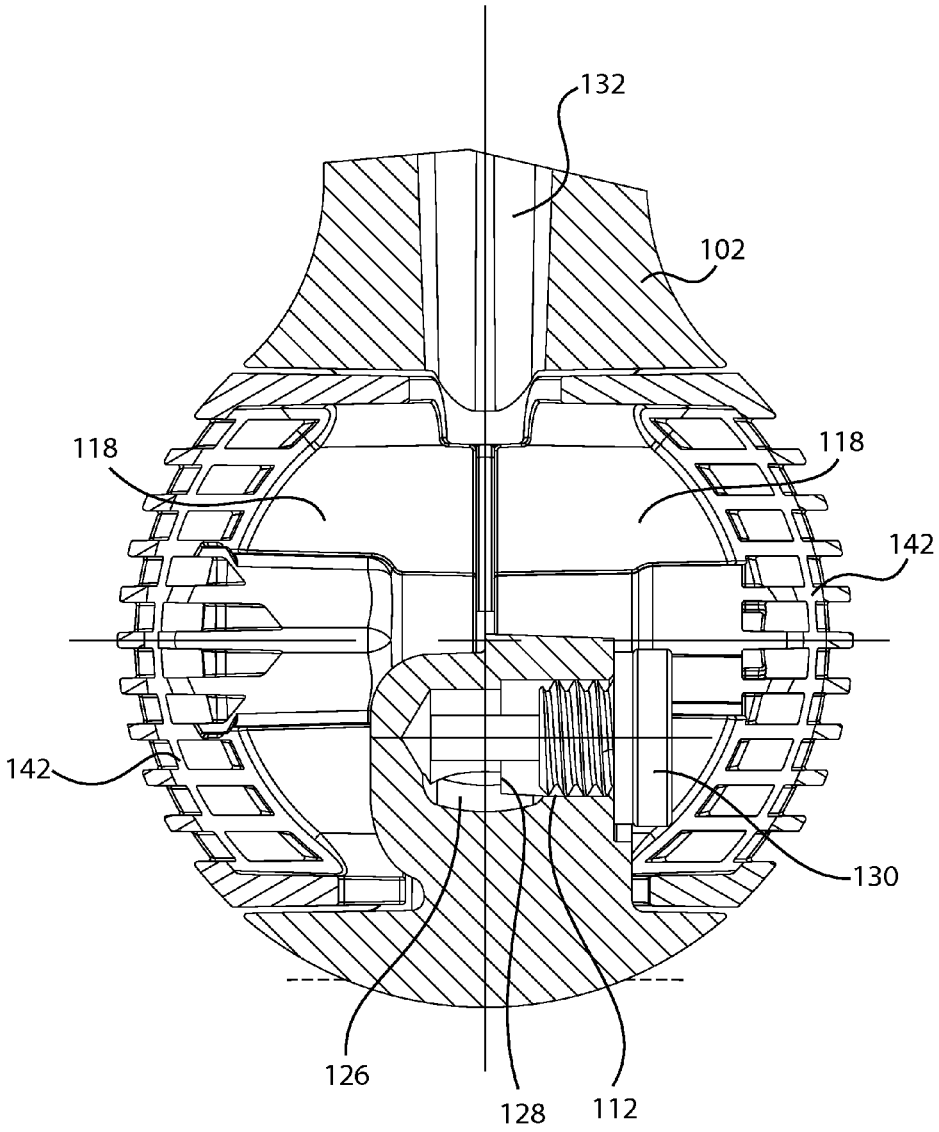
FIG. 4 is a cross-sectional view of the gear case assembly of the outboard engine of FIG. 1 taken through line A-A of FIG. 3.
Figure 5:
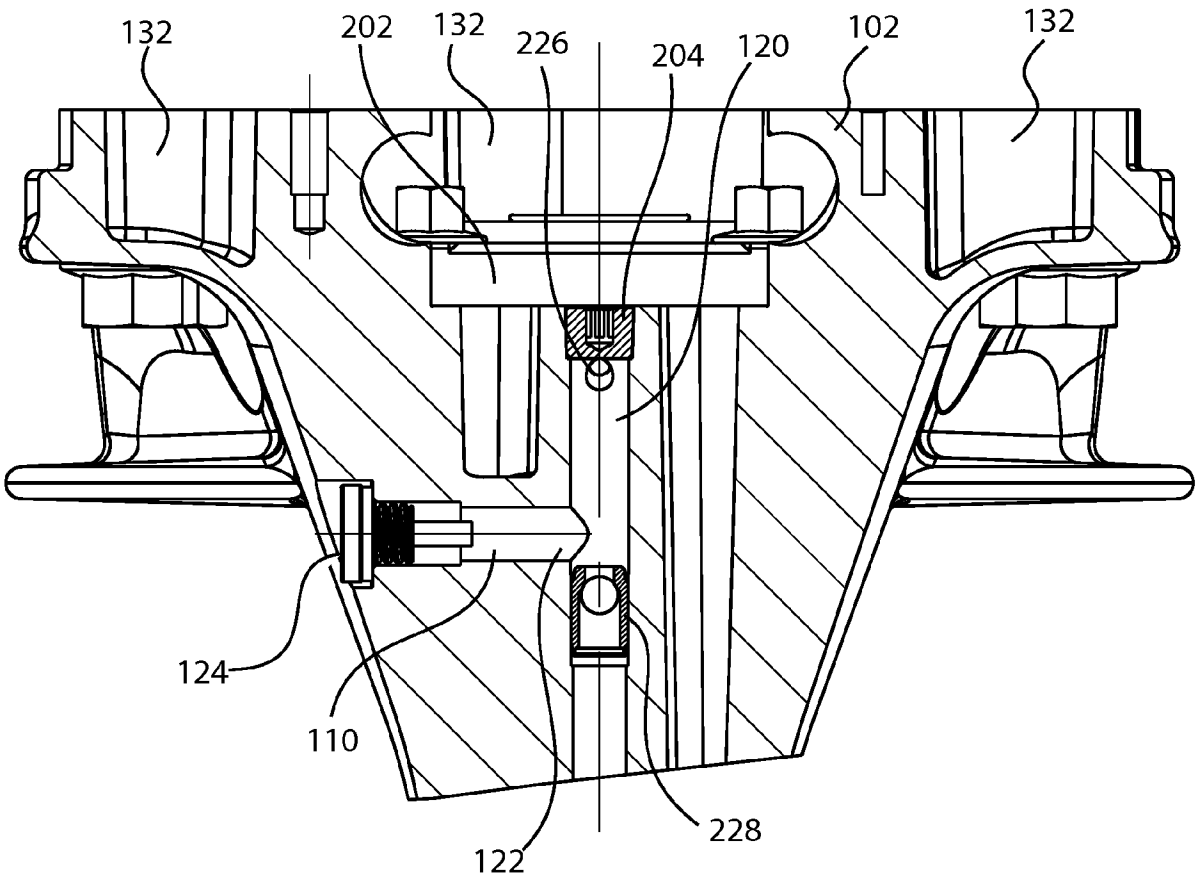
FIG. 5 is a cross-sectional view of the gear case assembly of the outboard engine of FIG. 1 taken through line B-B of FIG. 3.

As can be seen in FIG. 2, the gear case 102 defines upper and lower lubricant filling ports 110, 112, water outlets 114 and upper and lower water inlets 116, 118. The upper end of the gear case 102 has a number of apertures used to receive the fasteners (not shown) used to connect the gear case 102 to the bottom of the midsection 40 and/or the components housed therein. As their names suggests, the lower lubricant filling port 112 is disposed closer to the bottom end of the gear case 102 than the upper lubricant filling port 110. As best seen in FIG. 5, the upper lubricant filling port 110 communicates the exterior of the gear case 102 with a lubricant return passage 120 defined in the gear case 102. As can be seen, the inner end of the upper lubricant filling port 110 defines an aperture 122 in the wall of the lubricant return passage 120. The outer portion of the upper lubricant filling port 110 is threaded. A threaded plug 124 is fastened in the outer portion of the upper lubricant filling port 110 to close the upper lubricant filling port 110. As best seen in FIG. 2, the lower lubricant filling port 112 is located adjacent the lower water inlets 118, behind a screen 142. As best seen in FIG. 4, the lower lubricant filling port 112 communicates the exterior of the gear case 102 with a transmission chamber 126 defined in the gear case 102. As can be seen, the inner end of the lower lubricant filling port 112 defines an aperture 128 in the wall of the transmission chamber 126. The outer portion of the lower lubricant filling port 112 is threaded and opens in the lower water inlets 118. A threaded plug 130 is fastened in the outer portion of the lower lubricant filling port 112 to close the lower lubricant filling port 112. The threaded plugs 124 and 130 are screw and magnet assemblies, but it is contemplated that other types of plugs could be used.

Figure 9:
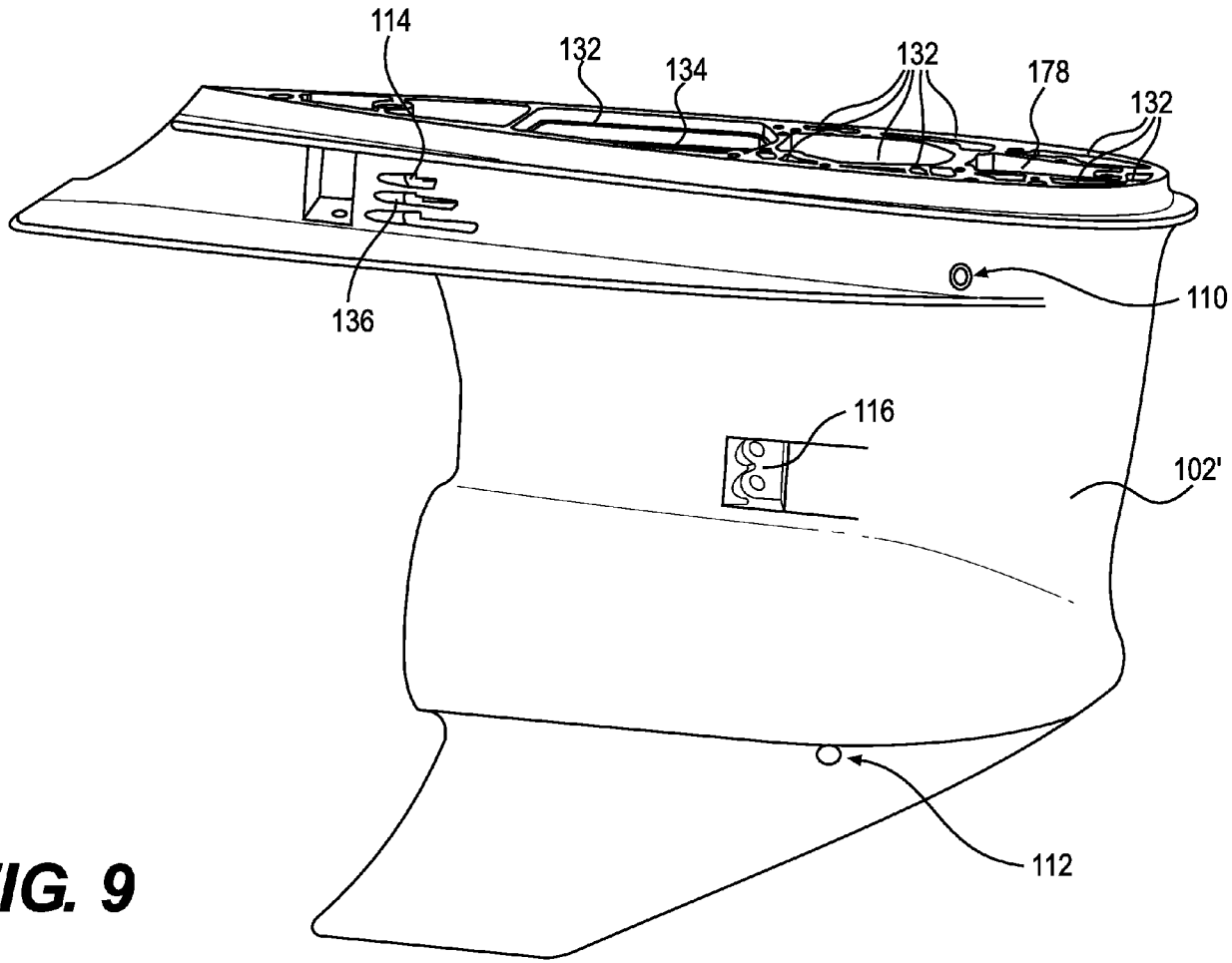
FIG. 9 is a perspective view taken from a front, right side of an alternative embodiment of a gear case of the outboard engine of FIG. 1.

In an alternative embodiment of the gear case 102 shown in FIG. 9, a gear case 102' does not have the water inlets 118 and has a lower lubricant filling port 112 that is disposed more rearward and lower than on the gear case 102. It is contemplated that the lower lubricant filling port 112 could be higher up the gear case 102, although nonetheless below the upper lubricant filling port 110.

Figure 10:
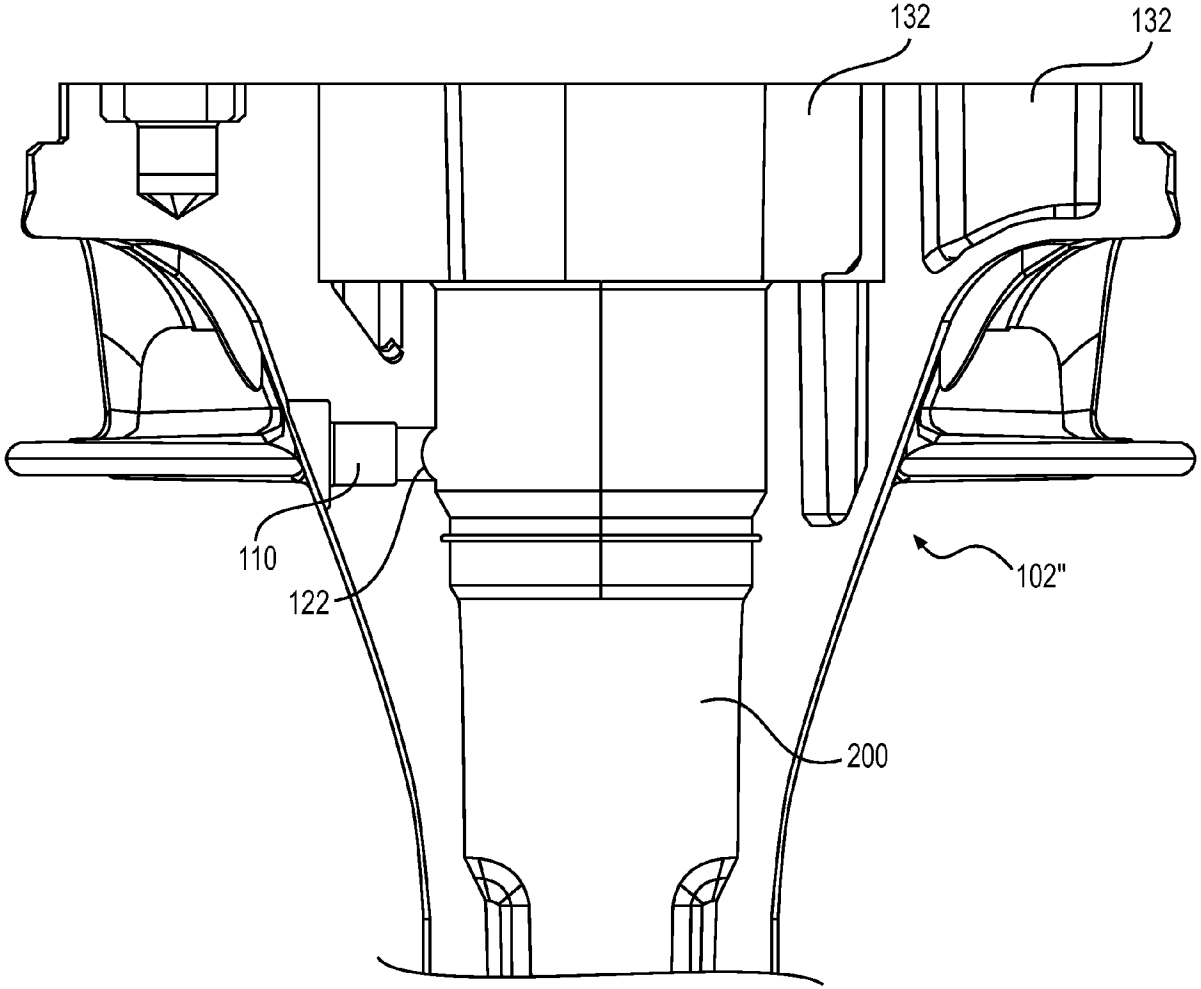
FIG. 10 is a lateral cross-section taken through a driveshaft passage of a portion of another alternative embodiment of a gear case of the outboard engine of FIG. 1.

FIG. 10 illustrates a gear case 102" which is another alternative embodiment of the gear case 102. In the gear case 102", the upper lubricant filling port 110 communicates the exterior of the gear case 102" with a driveshaft passage 200 defined in the gear case 102". The driveshaft passage 200 is described in greater detail below with respect to the gear case 102. The inner end of the upper lubricant filling port 110 defines the aperture 122 in the wall of the driveshaft passage 200. The outer portion of the upper lubricant filling port 110 is threaded. A threaded plug similar to the plug 124 shown in FIG. 5 is fastened in the outer portion of the upper lubricant filling port 110 to close the upper lubricant filling port 110. Other components of the gear case 102" and of components attached to or received in the gear case 102" are the same or similar to those described above and below with respect to the gear case 102 and as such will not be described again herein. When referring to such components with respect to the gear case 102", the same reference numerals as those used for the gear case 102 will be used.

Returning to the gear case 102, although both lubricant filling ports 110, 112 open on a right side of the gear case 102, it is contemplated that they could both open on the left side of the gear case 102 or on opposite sides of the gear case 102. It is contemplated that the lower lubricant filling port 112 could alternatively communicate the exterior of the gear case 102 with the lubricant return passage 120 and define an aperture in the wall of the lubricant return passage 120 at a position below the aperture 122.

The water inlets 116, 118 fluidly communicate the exterior of the gear case 102 with water passages 132 defined in the gear case 102 to provide cooling water throughout the drive unit 12 to cool components therein, such as the engine 36, an electronic management unit (not shown) and an exhaust passage 134. The passages 132 are connected to other passages (not shown) in the remainder of the drive unit 12 to cool these and other components of the outboard engine 10. After cooling the components, water leaves the drive unit 12 via the water outlets 114 and other water outlets (not shown). The water outlets 114 (disposed on each side of the gear case 102) are located near the top and rear of the gear case and are covered by screens 136 integrally formed with the gear case 102. The upper inlets 116 (one on each side of the gear case 102) are located near the center of the gear case 102. The upper inlets 116 are covered by screens 138. The screens 138 are held onto the gear case 102 by being fastened to each other by screws 140. The lower inlets 118 (one on each side of the gear case 102) are located lower than the upper inlets 116 near the front of the gear case 102. The lower inlets 118 are covered by screens 142. The screens 142 are held onto the gear case 102 by being fastened to each other by a bolt 144 and a nut 146. The screens 138 and 142 help prevent debris from being circulated in the water passages 132.

The driveshaft 42 is made of an upper portion 148 connected to the engine 36, a lower portion 150 connected to the upper portion 148 via splines, and defines a driveshaft axis 151. It is contemplated that the driveshaft 42 could be made of a single portion or of more than two portions. The lower portion 150 of the driveshaft 42 is mounted vertically near a longitudinal center of the gear case 102. The propeller shaft 106 is mounted in an orientation perpendicular to the driveshaft 42 and is selectively connected to the transmission 104 which is also coupled to the bottom of the lower portion 150 of the driveshaft 42. As mentioned above, the propeller 20 is connected to the rear end of the propeller shaft 106.

Two oppositely facing bevel gears 152, 154 of the transmission 104 are engaged to opposite sides of a complementary bevel gear 156, also referred to as a pinion. The bevel gear 156 is connected via splines to the bottom of the lower portion 150 of the driveshaft 42. The bevel gear 156 is held in place on the driveshaft 42 by a nut 158 threaded on the lower end of the lower portion 150 of the driveshaft 42. The bevel gears 152, 154 rotate with the driveshaft 42 but in opposite directions. Each bevel gear 152, 154 of the transmission 104 has a toothed plate 160, 162 respectively press-fit therein. The two plates 160, 162 face each other. The propeller shaft 106 is in splined connection with a sleeve 164 having a pair of outwardly facing toothed faces. The toothed faces of the sleeve 164 are selectively engaged with the toothed plates 160, 162 of one or the other of the bevel gears 152, 154 by translation of the sleeve 164 along the propeller shaft 106. Engagement of the sleeve 164 with a toothed plate 160 or 162 of a bevel gear 152 or 154 results in rotation of the propeller shaft 106 along with that bevel gear 152 or 154, thereby resulting in forward or reverse rotation of the propeller shaft 106. The sleeve 164 can also be located so as to be disengaged from both bevel gears 152, 154. This corresponds to a neutral operating condition of the transmission 104 where no torque is transferred from the engine 36 to the propeller shaft 106.

The above components of the transmission 104, including the lower end of the driveshaft 42, are disposed in the transmission chamber 126.

A shift rod 166 is selectively actuated along its axis to selectively actuate the sleeve 164. The vertically extending shift rod 166 is connected to one arm of an L-shaped rocker 168. The other arm of the L-shaped rocker 168 is connected to a shaft 170. The shaft 170 is disposed within a bore defined along the forward end of the propeller shaft 106. The shift rod 166, the rocker 168, the shaft 170, the pin 172 and the forward end of the propeller shaft 106 are also disposed in the combustion chamber 126. The shaft 170 is connected to the sleeve 164 via a pin 172 extending through the rear end of the shaft 170, a slot in the propeller shaft 106 and holes in the sleeve 164. When the shift rod 166 is pulled upwards, the rocker 168 is pulled up, thereby pulling the shaft 170 forward (towards the right in FIG. 3), which in turn pulls the sleeve 164 forward, thereby engaging the plate 160 of the bevel gear 152. When the shift rod 166 is pushed downwards, the rocker 168 is pushed down, thereby pushing the shaft 170 rearward (towards the left in FIG. 3), which in turn pushes the sleeve 164 rearward, thereby engaging the plate 162 of the bevel gear 154. Moving the shift rod 166 to a position intermediate these up and down positions moves the sleeve 164, via the shaft 170, to a neutral position between the plates 160 162 of the bevel gears 152, 154 where both plates 160, 162 of the bevel gears 152, 154 are not engaged by the sleeve 164.

Figure 3:
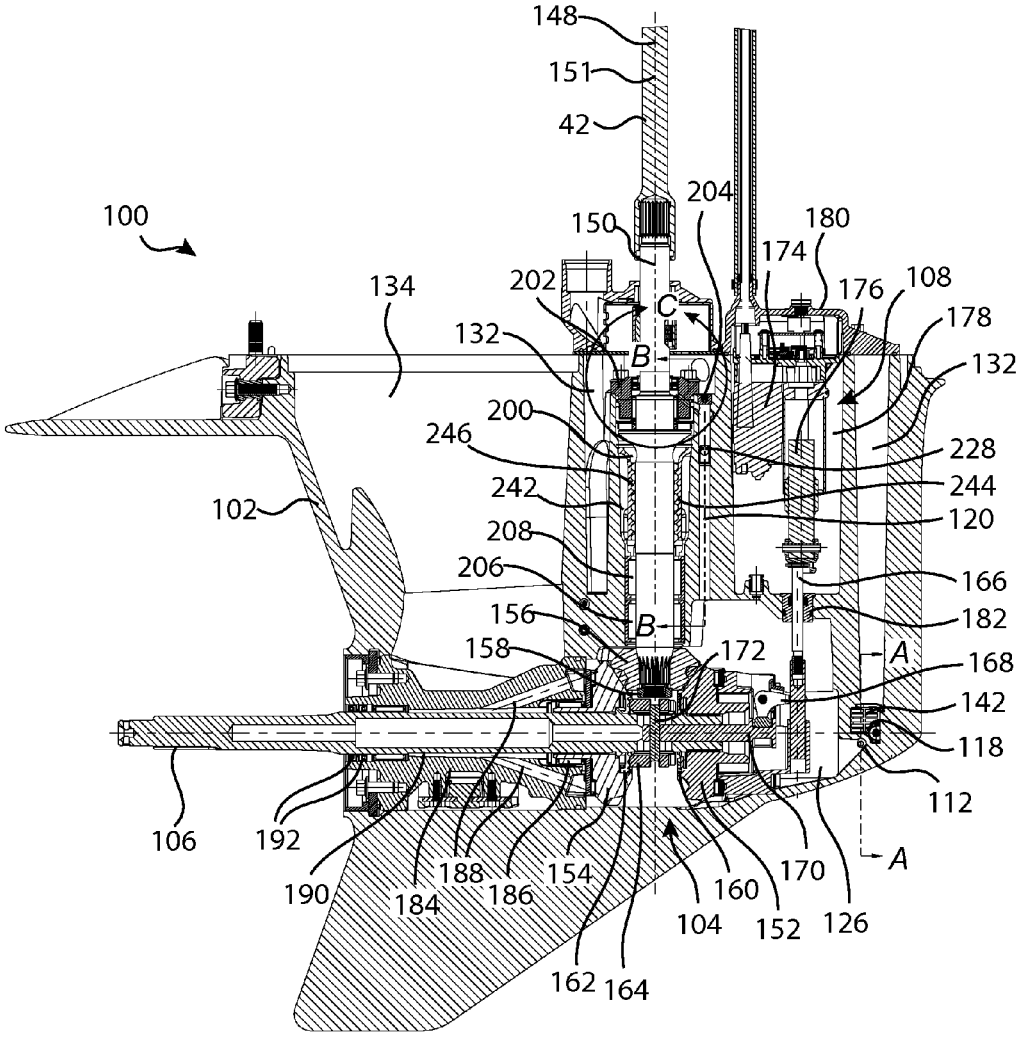
FIG. 3 is a partial vertical cross-section of a gear case assembly of the outboard engine of FIG. 1 taken along a center of the gear case.

The electric transmission actuator assembly 108 is used to actuate the vertically extending shift rod 166. The electric transmission actuator assembly 108 has an electric motor 174 connected to a linear actuator 176 extending vertically downwards. The actuator assembly 108 is located in an actuator chamber 178 formed by the gear case 102 and closed by a cover 180. As can be seen in FIG. 3, the actuator chamber 178 is disposed forward to the lubricant passage 120 and above the transmission chamber 126. The actuator chamber 178 is sealed so as to prevent the intrusion of water and lubricant therein. The actuation of the actuator 176 is controlled by providing appropriate logic signals to the electric motor 174. The lower end of the actuator 176 engages an upper end of the shift rod 166. The actuator 176 actuates the sleeve 164 by actuating the shift rod 166 vertically along the central axis of the shift rod 166. A seal 182 is provided around the shift rod 166 where it passes through the lower wall of the chamber 178 to prevent the entry of lubricant inside the actuator chamber 178. It is contemplated that the actuator 176 could be a rotary actuator. Other configurations of the transmission 104 with different shifting mechanisms are also contemplated.

The propeller shaft 106 is rotationally supported inside a propeller shaft housing 184 by a pair of needle bearings 186. Passages 188 formed in the propeller shaft housing 184 fluidly communicate the transmission chamber 126 with the space 190 defined between the propeller shaft housing 184 and the propeller shaft 106 thus permitting lubricant to flow to the needle bearings 186. Seals 192 disposed between the propeller shaft 106 and the propeller shaft housing 184 rearward the of the rear needle bearing 186 prevent lubricant from leaking in the water in which the outboard engine 10 is being operated.

Figure 6:
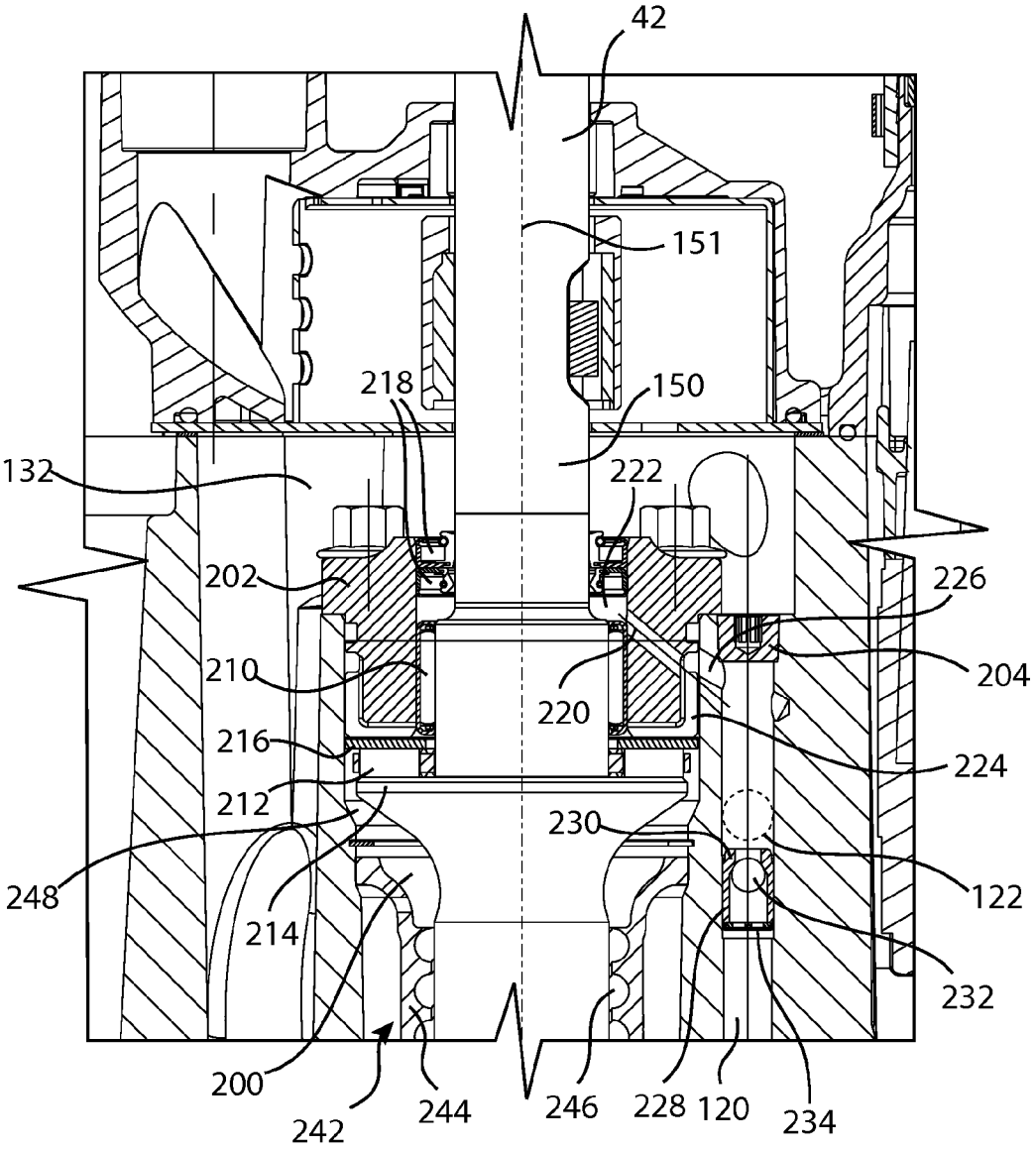
FIG. 6 is a close-up view of portion C-C of FIG. 3.

As best seen in FIGS. 3 and 6, the lower portion 150 of the driveshaft 42 extends through the driveshaft passage 200. The driveshaft passage 200 is defined by the gear case 102. The driveshaft passage 200 is disposed rearward of the actuator chamber 178 and of the lubricant return passage 120. The lower end of the driveshaft passage 200 communicates with the transmission chamber 126. The upper end of the driveshaft passage 200 is located below the top of the gear case 102. To separate the driveshaft passage 200 from the water passage 132 shown in FIG. 6, a cap 202 is fastened to the upper end of wall defining the driveshaft passage 200. As can also be seen in these figures, the upper end of the lubricant return passage 120 is also closed by a cap 204. The diameter of the driveshaft passage 200 is larger than the diameter of the lubricant return passage 120.

The driveshaft 42 is rotationally supported in the driveshaft passages 200 by needle bearings 206, 208, 210, 212. The bearings 206 and 208 (FIG. 3) are disposed between the lower portion 150 of the driveshaft 42 and the lower portion of the wall defining the driveshaft passage 200. The bearing 210 (FIG. 6) is disposed between the lower portion 150 of the driveshaft 42 and the inner wall of the cap 202. The bearing 212 (FIG. 6) is disposed between a flange 214 formed by the lower portion 150 of the driveshaft 42 and a thrust washer 216. The thrust washer 216 is disposed above the bearing 212 and below both the bearing 210 and the cap 202. A pair of seals 218 disposed between the lower portion of the driveshaft 42 and the inner wall of the cap 202 at a top thereof prevent water in the water passage from entering the driveshaft passage 200 and lubricant in the driveshaft passage 200 from entering the water passage 132.

As best seen in FIG. 6, a connection passage 220 is defined in the cap 202. The inlet of the connection passage 220 is defined in the inner wall of the cap 202 so as to fluidly communicate with the portion 222 of the driveshaft passage 200 defined between the lower portion 150 of the driveshaft 42, the inner wall of the cap 202, the lower seal 218 and the top of the bearing 210. From its inlet, the connection passage 220 extends downwardly to its outlet. The outlet of the connection passage 220 is defined in an outer wall of the cap 202 so as to fluidly communicate with the portion 224 of the driveshaft passage 200 defined between the cap 202, the wall defining the driveshaft passage 200, the bearing 210 and the thrust washer 216. Another connection passage 226 fluidly communicates the driveshaft passage 200 with the lubricant return passage 120. The connection passage 226 is defined in the wall of the gear case 102 located between the lubricant return passage 120 and the driveshaft passage 200. As can be seen in FIGS. 5 and 6, the connection passage 226 is disposed above the lubricant filling port 110 (the aperture 122 defined by the filling port 110 in the passage 120 being shown in dotted lines in FIG. 6). The inlet of the connection passage is defined in the wall of the driveshaft passage 200 so as to communicate with the portion 224 of the driveshaft passage. From its inlet, the connection passage 226 extends downwardly to its outlet defined in the wall defining the lubricant return passage 120 near a top thereof. As can be seen in FIG. 6, the diameter of the lubricant return passage 120 is larger than the diameter of the connection passages 220, 226. It is contemplated that the connection passage 226 could be omitted and that the lubricant return passage 120 could be shaped so as to fluidly communicate directly with the driveshaft passage 200 at or near an upper end of the lubricant return passage 120.

A check valve 228 is disposed in the lubricant return passage 120 at a position below the connection passage 226 and the lubricant filling port 110 (see FIG. 5). In the gear case 102" shown in FIG. 10, the check valve 228 is also disposed in the lubricant return passage 120 at a position below the connection passage 226 and the lubricant filling port 110.

Figure 7:
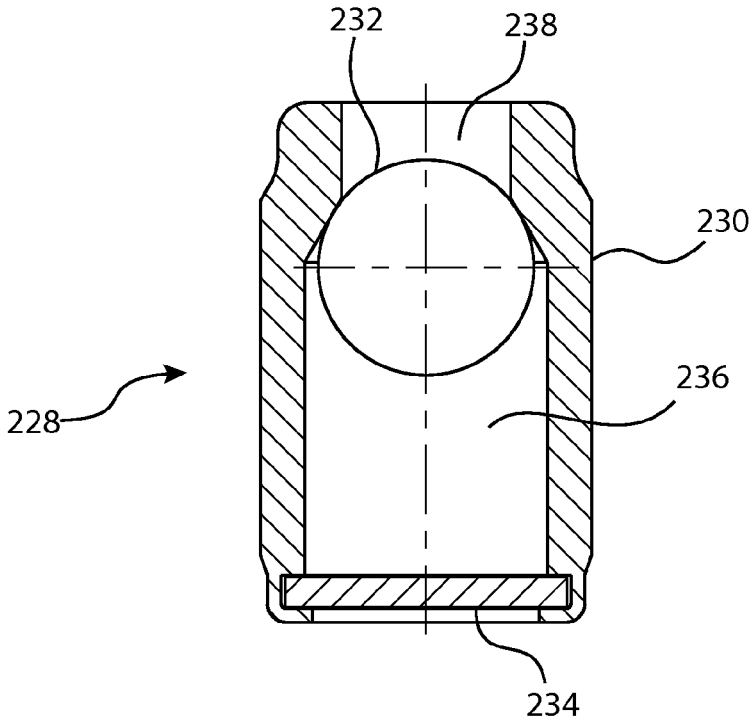
FIG. 7 is a cross-sectional view of a check valve of the gear case assembly of the outboard engine of FIG. 1.
Figure 8:
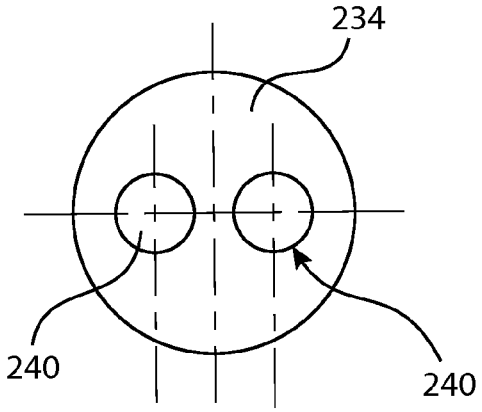
FIG. 8 is an end view of an end disk of the check valve of FIG. 7.

Returning to the gear case 102, as the lubricant return passage 120 is disposed above the transmission chamber 126 and the lubricant filling port 112 opens in the transmission chamber 126, the check valve 228 is disposed above the lubricant filling port 112. In an embodiment where the lubricant filling port 112 opens in the lubricant return passage 120, the check valve 228 is disposed above the point where the lubricant filling port 112 opens in the lubricant return passage 120. The check valve 228 permits lubricant to flow through it in a direction toward the transmission chamber 126 (i.e. down in the figures) so as to be returned to the transmission chamber 126. The check valve 228 prevents lubricant from flowing through it in a direction away from the transmission chamber (i.e. up in the figures). In the present embodiment, the check valve 228 is a ball valve, but other types of check valves are contemplated. As best seen in FIG. 7, the check (ball) valve 228 includes a cylindrical body 230, a ball 232 disposed in the cylindrical body 230 and an end disk 234. The cylindrical body 230 has an inner passage 236 having a diameter that is larger than the diameter of the ball 232 and another inner passage 238 extending from the passage 236 having a diameter that is smaller than the diameter of the ball 232. The end disk 234 is disposed in the inner passage 236 near the end of the cylindrical body 230 to prevent the ball from falling out of the cylindrical body 230. As can be seen in FIG. 8, the end disk 234 has a pair of off-center apertures 240. The apertures 240 are off-center so as not to be closed by the ball 232 when the ball 232 abuts the end disk 234. It is contemplated that the end disk 234 could have only one or more than two apertures 240.

With reference to the orientation of the check valve 228 shown in FIG. 7, when lubricant enters the cylindrical body 230 from its top and flows down, the ball 232 is pushed down and the lubricant can flow through the inner passage 238, then through the inner passage 236 around the ball 232, and finally out of the check valve through the apertures 240 of the end disk 234. Still with reference to the orientation of the check valve 228 shown in FIG. 7, when lubricant enters the cylindrical body 230 from its bottom and flows up, the lubricant flow in through the apertures 240 of the end disk 234 and as the flows up in the inner passage 236, the ball 232 is pushed up by the lubricant and blocks the inner passage 238, as shown throughout the figures, thus preventing the lubricant to flow through the check valve 228 in this direction.

In order to circulate the lubricant inside the gear case 102 and to supply lubricant to the bearings 210, 212, a pump that is driven by the driveshaft 42 is provided in the gear case 102. In the present embodiment the pump is an Archimedes screw 242. It is contemplated that other types of pumps could be used. For example, one or both of the bevel gears 152, 154 could be adapted to operate as pumps in addition to transferring torque from the driveshaft 42 to the propeller shaft 106. The Archimedes screw 242 is formed by a portion of the lower portion 150 of the driveshaft 42 and a pump housing 244. The pump housing 244 is disposed inside the driveshaft passage 200 around the lower portion 150 of the driveshaft 42. As can be seen, the pump housing is disposed above the bearings 206, 208 and below the flange 214 and the lubricant filling port 122. The pump housing 244 defines an internal thread 246. As the driveshaft 42 rotates, lubricant is caused to move up inside the thread 246, thus pumping lubricant located below the Archimedes screw 242 to a location above the Archimedes screw 242. In an alternative embodiment, the thread 246 is omitted and an external thread is defined on the lower portion 150 of the driveshaft 42. In the present embodiment, the lubricant is marine grade oil, but it is contemplated that other types of lubricants could be used.

During operation of the outboard engine 10, when the engine 36 is operating, the rotation of the driveshaft 42 operates the Archimedes screw 242. As a result, lubricant is pumped from the transmission chamber 126, up around the bevel gear 156, enters the driveshaft passage 200, flows through the bearings 206, 208 and enters the Archimedes screw 242. The lubricant then flows up the Archimedes screw 242, enters the portion 248 of the driveshaft passage 200 where the bearing 212 is located, thereby lubricating the bearing 212. From the portion 248 of the driveshaft passage 200, the lubricant flows around the thrust washer 216 and enters the portion 224 of the driveshaft passage 200. From the portion 224 of the driveshaft passage 200, some of the lubricant flows through the bearing 210, enters the portion 222 of the driveshaft passage 200 and is then returned to the portion 224 of the driveshaft passage 200 via the connection passage 220. From the portion 224 of the driveshaft passage 200, some of the lubricant flows through the connection passage 226 into the lubricant return passage 120 and flows down toward the transmission chamber 126. As it is flowing toward the transmission chamber 126, the lubricant can flow through the check valve 228 and then down the rest of the lubricant return passage 120 to return to the transmission chamber 126.

To remove the lubricant from the gear case 102 prior to filling it with new lubricant, both plugs 124, 130 are removed from their respective lubricant filling ports 110, 112. The lubricant within the gear case 102 can then flow out the lower filling port 112. In this context, the lower filling port 112 can be referred to as a "drain" and the upper filling port 110 as the vent. In order to fill the gear case 102 after either having removed the lubricant as described above or prior to the engine's first use, both plugs 124, 130 remain removed and lubricant is pumped inside the lubricant filling port 112. As lubricant is pumped through the lubricant filling port 112, the level of lubricant rises in the lubricant chamber 126 and lubricant also fills the passages 188 and the space 190 around the propeller shaft 106. When the level of lubricant reaches the lower end of the driveshaft passage 200, lubricant starts filling the driveshaft passage 200. However, since the bearings 206 and 208 and the Archimedes screw 242 cause obstructions to the flow of lubricant in the driveshaft passage 200, the lubricant takes the path of least resistance and the level of lubricant starts to rise faster in the remainder of the transmission chamber 126 than in the driveshaft passage 200. Once the level of lubricant reaches the bottom of the lubricant return passage 120, the transmission chamber 126 is filled with lubricant and lubricant starts to rise inside the lubricant return passage 126. Due to the smaller diameter of the lubricant return passage and the absence of obstructions such as the bearings 206 and 208 and the Archimedes screw 242, the level of lubricant inside the lubricant return passage 126 rises even faster compared to the speed at which the level of lubricant rises in the driveshaft passage 200. The lubricant level continues to rise inside the lubricant return passage 120 until it reaches the check valve 228. When the lubricant reaches the check valve 228, the lubricant pushes the ball 232 up as shown in FIG. 6, thereby preventing lubricant from rising further inside the lubricant return passage 200 and from reaching the lubricant filling port 110. Once the check valve 228 is closed, the additional lubricant being pumped inside the lubricant filling port 112 causes the level of lubricant to rise inside the driveshaft passage 200. Once the driveshaft passage 200 is filled and the lubricant reaches the inlet of the connection passage 220, lubricant flows through the connection passages 220, 226 and into the lubricant return passage 120 above the check valve 228. The lubricant entering the lubricant return passage 120 via the connection passage 226 starts filling the portion of the lubricant return passage 120 above the check valve 228, then reaches the level of the lubricant filling port 110 and flows out of the lubricant filling port 110 to the exterior of the gear case 102, thereby giving a visual indication that the lubricant filling operation is complete. The plugs 124, 130 are then reinserted in their respective oil filling ports 110, 112.

For the gear case 102" shown in FIG. 10, lubricant is removed in the same manner as described above with respect to the gear case 102. In order to fill the gear case 102" after either having removed the lubricant as described above or prior to the engine's first use, both plugs 124, 130 remain removed and lubricant is pumped inside the lubricant filling port 112. As lubricant is pumped through the lubricant filling port 112, the level of lubricant rises in the lubricant chamber 126 and lubricant also fills the passages 188 and the space 190 around the propeller shaft 106. When the level of lubricant reaches the lower end of the driveshaft passage 200, lubricant starts filling the driveshaft passage 200. However, since the bearings 206 and 208 and the Archimedes screw 242 cause obstructions to the flow of lubricant in the driveshaft passage 200, the lubricant takes the path of least resistance and the level of lubricant starts to rise faster in the remainder of the transmission chamber 126 than in the driveshaft passage 200. Once the level of lubricant reaches the bottom of the lubricant return passage 120, the transmission chamber 126 is filled with lubricant and lubricant starts to rise inside the lubricant return passage 126. Due to the smaller diameter of the lubricant return passage and the absence of obstructions such as the bearings 206 and 208 and the Archimedes screw 242, the level of lubricant inside the lubricant return passage 126 rises even faster compared to the speed at which the level of lubricant rises in the driveshaft passage 200. The lubricant level continues to rise inside the lubricant return passage 120 until it reaches the check valve 228. When the lubricant reaches the check valve 228, the lubricant pushes the ball 232 up as shown in FIG. 6, thereby preventing lubricant from rising further inside the lubricant return passage 200. Once the check valve 228 is closed, the additional lubricant being pumped inside the lubricant filling port 112 causes the level of lubricant to rise inside the driveshaft passage 200. Once lubricant reaches the level of the aperture 122 defined by the lubricant filling port 110 in the driveshaft passage 200, lubricant flows out of the lubricant filling port 110 to the exterior of the gear case 102", thereby giving a visual indication that the lubricant filling operation is complete. As the aperture 122 is disposed below the inlet of the connection passage 220, lubricant does not flow through the connection passages 220, 226 and into the lubricant return passage 120 above the check valve 228 as in the gear case 122. Once lubricant flows out of the lubricant filling port 110 to the exterior of the gear case 102", the plugs 124, 130 are reinserted in their respective oil filling ports 110, 112.

As would be understood, the steps for removing the lubricant from the gear cases 102 and 102" and for filling the gear cases 102 and 102" with lubricant are performed when the outboard engine 10 is not in operation with the engine 36 stopped.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A gear case assembly for a marine propulsion system comprising:

a gear case having a first end and a second end, the first end being adapted to connect the gear case to a remainder of the marine propulsion system, the second end being disposed opposite the first end;

a driveshaft disposed at least in part in the gear case, the driveshaft having a driveshaft axis;

a propeller shaft operatively connected to an end of the driveshaft, the propeller shaft being disposed at an angle to the driveshaft;

a transmission chamber defined in the gear case, the end of the driveshaft and at least a portion of the propeller shaft being disposed in the transmission chamber;

a driveshaft passage fluidly connected to the transmission chamber, the driveshaft passage housing at least a portion of the driveshaft, the driveshaft passage being disposed between the first end of the gear case and the transmission chamber in a direction parallel to the driveshaft axis;

a lubricant return passage fluidly connected to the transmission chamber and the driveshaft passage, the lubricant return passage being disposed between the first end of the gear case and the transmission chamber in a direction parallel to the driveshaft axis;

a pump driven by the driveshaft, during operation of the driveshaft:

the pump pumps lubricant from the transmission chamber to the driveshaft passage, and from the driveshaft passage, the lubricant flows through the lubricant return passage and back to the transmission chamber;

a first lubricant filling port for fluidly communicating one of the lubricant return passage and the driveshaft passage with an exterior of the gear case, the first lubricant filling port defining an aperture in the one of the lubricant return passage and the driveshaft passage;

a first plug selectively disposed in the first lubricant filling port;

a second lubricant filling port for fluidly communicating one of the lubricant return passage and the transmission chamber with the exterior of the gear case, the second lubricant filling port defining an aperture in the one of the lubricant return passage and the transmission chamber, the second lubricant filling port being closer to the second end of the gear case than the first lubricant filling port in the direction parallel to the driveshaft;

a second plug selectively disposed in the second lubricant filling port; and a check valve disposed in the lubricant return passage between the first and second lubricant filling ports in the direction parallel to the driveshaft axis, the check valve permitting lubricant to flow through the check valve toward the transmission chamber, the check valve preventing lubricant to flow through the check valve away from the transmission chamber.

2. The gear case assembly of claim 1, wherein the first lubricant filling port fluidly communicates the lubricant return passage with the exterior of the gear case and the aperture defined by the first lubricant filling port is defined in the lubricant return passage.

3. The gear case assembly of claim 1, wherein the second lubricant filling port fluidly communicates the transmission chamber with the exterior of the gear case and the aperture defined by the second lubricant filling port is defined in the transmission chamber.

4. The gear case assembly of claim 1, wherein the propeller shaft is perpendicular to the driveshaft.

5. The gear case assembly of claim 1, further comprising:

a first bevel gear disposed on the end of the driveshaft; and a second bevel gear operatively connected to the propeller shaft, the second bevel gear meshing with the first bevel gear;

wherein the first and second bevel gears are disposed in the transmission chamber.

6. The gear case assembly of claim 5, wherein the second bevel gear is selectively connected to the propeller shaft; and further comprising:

a third bevel gear selectively connected to the propeller shaft, the third bevel gear meshing with the first bevel gear, the third bevel gear is disposed in the transmission chamber, the second and third bevel gears being disposed on opposite sides of the driveshaft axis; and a transmission actuator assembly for selectively operatively connecting one of the second and third bevel gears with the propeller shaft, the one of the second and third bevel gears driving the propeller shaft.

7. The gear case assembly of claim 6, further comprising:

a sleeve disposed on the propeller shaft, the sleeve being slidable along the propeller shaft, the sleeve being rotationally fixed relative to the propeller shaft;

a rocker connected to the sleeve; and a shift rod connected to the rocker and the transmission actuator assembly;

wherein the transmission actuator assembly causes translation of the shift rod, which in turn causes the rocker to move the sleeve to one of:

a first position where the sleeve engages the second bevel gear;

a second position where the sleeve engages the third bevel gear; and a neutral position where the sleeve is disengaged from both the second and third bevel gears.

8. The gear case assembly of claim 6, wherein the transmission actuator assembly includes an electric motor.

9. The gear case assembly of claim 6, wherein the transmission actuator assembly is disposed at least in part in an actuator chamber formed by the gear case.

10. The gear case assembly of claim 9, wherein the actuator chamber is disposed forward of the lubricant return passage and the driveshaft passage;

wherein the actuator chamber is disposed between the transmission chamber and the first end of the gear case in the direction parallel to the driveshaft axis; and wherein the lubricant return passage is disposed between the actuator chamber and the driveshaft passage.

11. The gear case assembly of claim 1, wherein the pump is an Archimedes screw.

12. The gear case assembly of claim 11, wherein the Archimedes screw includes a pump housing disposed in the driveshaft passage around the driveshaft, the pump housing defining an internal thread.

13. The gear case assembly of claim 11, wherein the first lubricant filling port is disposed between the Archimedes screw and the first end of the gear case in the direction parallel to the driveshaft.

14. The gear case assembly of claim 1, further comprising a connection passage fluidly communicating the driveshaft passage with the lubricant return passage.

15. The gear case assembly of claim 14, wherein the connection passage is disposed between the first lubricant filling port and the first end of the gear case in the direction parallel to the driveshaft.

16. The gear case assembly of claim 14, further comprising a bearing disposed between the driveshaft and a wall of the driveshaft passage;

wherein an inlet of the connection passage is disposed closer to the first end of the gear case than the bearing in the direction parallel to the driveshaft.

17. The gear case assembly of claim 16, wherein the bearing is disposed between the first lubricant filling port and the second end of the gear case in the direction parallel to the driveshaft.

18. The gear case assembly of claim 1, wherein the check valve is a ball valve.

19. The gear case assembly of claim 1, wherein the first lubricant filling port fluidly communicates the one of the lubricant return passage and the driveshaft passage with a first side of the exterior of the gear case; and the second lubricant filling port fluidly communicates the one of the lubricant return passage and the transmission chamber with the first side of the exterior of the gear case.

20. The gear case assembly of claim 1, wherein a diameter of the driveshaft passage is larger than a diameter of the lubricant return passage.

21. The gear case assembly of claim 14, wherein a diameter of the lubricant return passage is larger than a diameter of the connection passage.

22. A marine outboard engine comprising:

an engine;

a cowling housing at least in part the engine;

a midsection connected to the engine;

a gear case having a first end and a second end, the first end being connected to the midsection, the second end being disposed opposite the first end;

a driveshaft disposed at least in part in the gear case and being operatively connected to the engine, the driveshaft having a driveshaft axis;

a propeller shaft operatively connected to an end of the driveshaft, the propeller shaft being disposed at an angle to the driveshaft;

a propeller mounted on the propeller shaft;

a transmission chamber defined in the gear case, the end of the driveshaft and at least a portion of the propeller shaft being disposed in the transmission chamber;

a driveshaft passage fluidly connected to the transmission chamber, the driveshaft passage housing at least a portion of the driveshaft, the driveshaft passage being disposed between the first end of the gear case and the transmission chamber in a direction parallel to the driveshaft axis;

a lubricant return passage fluidly connected to the transmission chamber and the driveshaft passage, the lubricant return passage being disposed between the first end of the gear case and the transmission chamber in a direction parallel to the driveshaft axis;

a pump driven by the driveshaft, during operation of the driveshaft:

the pump pumps lubricant from the transmission chamber to the driveshaft passage, and from the driveshaft passage, the lubricant flows through the connection passage into the lubricant return passage and back to the transmission chamber;

a first lubricant filling port for fluidly communicating one of the lubricant return passage and the driveshaft passage with an exterior of the gear case, the first lubricant filling port defining an aperture in the one of the lubricant return passage and the driveshaft passage;

a first plug selectively disposed in the first lubricant filling port;

a second lubricant filling port for fluidly communicating one of the lubricant return passage and the transmission chamber with the exterior of the gear case, the second lubricant filling port defining an aperture in the one of the lubricant return passage and the transmission chamber, the second lubricant filling port being closer to the second end of the gear case than the first lubricant filling port in the direction parallel to the driveshaft;

a second plug selectively disposed in the second lubricant filling port; and a check valve disposed in the lubricant return passage between the first and second lubricant filling ports in the direction parallel to the driveshaft axis, the check valve permitting lubricant to flow through the check valve toward the transmission chamber, the check valve preventing lubricant to flow through the check valve away from the transmission chamber.

* * * * *